US005966956A

United States Patent [19]

Morris et al.

[11] Patent Number: 5,966,956

[45] Date of Patent: Oct. 19, 1999

[54] PORTABLE REFRIGERATED STORAGE UNIT

[75] Inventors: Leland M. Morris, Boca Raton; James Rogers, Quincy, both of Fla.

[73] Assignee: Shelter Technologies, Inc., Boca Raton, Fla.

[21] Appl. No.: 08/968,508

[22] Filed: Nov. 12, 1997

Related U.S. Application Data

[60] Provisional application No. 60/035,153, Nov. 20, 1996.

[51] Int. Cl.[6] ..... F25D 23/12; E04B 7/16

[52] U.S. Cl. ..... 62/259.1; 62/371; 52/69; 52/71; 52/79.5

[58] Field of Search ..... 62/440, 259.1, 62/371; 52/64, 68, 69, 71, 79.5

[56] References Cited

U.S. PATENT DOCUMENTS

| | | | |
|---|---|---|---|
| 2,167,557 | 7/1939 | Stout | 52/69 |
| 2,395,691 | 2/1946 | Smith | 52/69 |
| 2,886,856 | 5/1959 | Suk Kun Che . | |
| 2,904,850 | 9/1959 | Couse et al. | 52/69 |
| 2,992,828 | 7/1961 | Stewart . | |
| 3,107,116 | 10/1963 | Meaker | 52/79.5 |
| 3,182,424 | 5/1965 | Betjemann . | |
| 3,195,190 | 7/1965 | Malo . | |
| 3,832,956 | 9/1974 | Briel | 52/122 |
| 3,983,665 | 10/1976 | Burton . | |
| 3,984,948 | 10/1976 | Bussard . | |
| 4,155,204 | 5/1979 | Prozinski . | |
| 4,534,141 | 8/1985 | Fagnoni . | |
| 4,545,171 | 10/1985 | Colvin . | |
| 4,633,626 | 1/1987 | Freeman et al. . | |
| 4,660,332 | 4/1987 | Colvin, Jr. . | |
| 4,891,919 | 1/1990 | Palibroda . | |
| 4,912,891 | 4/1990 | Betrand . | |
| 5,245,838 | 9/1993 | Cavalea | 62/259.1 |
| 5,345,730 | 9/1994 | Jurgensen | 52/64 |
| 5,447,000 | 9/1995 | Larsen | 52/79.1 |
| 5,461,832 | 10/1995 | Smith | 52/69 |
| 5,546,758 | 8/1996 | Hintermeier | 62/259.1 |
| 5,761,854 | 6/1998 | Johnson et al. | 52/69 |
| 5,765,316 | 6/1998 | Kavarsky | 52/67 |

*Primary Examiner*—William Doerrler
*Attorney, Agent, or Firm*—Dickstein Shapiro Morin & Oshinsky LLP

[57] ABSTRACT

A portable unit which is foldable to be shipped and transported as a standard cargo shipping container is disclosed. The portable unit may function as a portable shelter which may be easily transported and usable on a variety of terrains and surfaces without a foundation. The portable shelter contains a refrigeration system which provides air conditioning and/or heating for living quarters or for controlled environment storage, such as a portable mortuary used in emergency situations.

17 Claims, 14 Drawing Sheets

PORTABLE REFRIGERATED STORAGE UNIT

This application claims priority under 35 U.S.C. 119(e), a provisional application No., 60/035,153, was filed Nov. 20, 1996.

BACKGROUND OF THE INVENTION

This invention relates in general to a folding portable building and more particularly to a unit that can be transported as a standard cargo shipping container when in the closed position and can be opened, without heavy tools and equipment, to provide a shelter or enclosure several times the size of the closed container. The unit may be a shelter or a refrigerated storage container.

Portable prefabricated structures, such as mobile homes, have been used to provide temporary or semipermanent building space. However, as the size of the structure increases, the ease with which they can be transported is reduced. Large structures have to be divided into parts and transported separately on oversized trucks. When not in use, the structures require significant space for storage. Generally, a foundation or pier must first be constructed to provide a strong flat surface for the structure.

A number of folding structures have been devised to address these transportability and space problems. Two structures are shown in U.S. Pat. Nos. 4,545,171 and 4,891,919.

U.S. Pat. No. 4,545,171 discloses a structure having hinged roofs, floors and walls. Although its collapsible design makes it easier to transport, this structure is not made according to container shipping industry standards and requires specialized handling in transit. The structure also requires a concrete foundation, which can defeat any advantage for use as a temporary structure. The structure is designed to be permanently installed with various components being attached with nails and bolts. The interior surfaces, such as walls, paint, wallpaper, floors, and carpets are installed after assembly. Also, a gable is required above the front and rear wall sections in order to provide sufficient protection for the attic area from the weather. The gable increases the cost and complexity in fabrication and assembly of the collapsible structure.

U.S. Patent No. 4,891,919 discloses a house erected from and supported by a standard size cargo shipping container with hinged walls and floor panels. After the wall and floor panels are unfolded, the roof and end walls, which are transported inside the container, are removed and assembled to complete the house. Although transportation of the structure is simplified by the use of a standard size cargo shipping container, the complexity of assembly is increased through the use of the separable parts for the roof and walls which need to be lifted into position and attached. In fact, the patent states that assembly generally will take five days with four people. A specialized foundation is required to support the floor panels above the level of the container bottom. The arrangement of the hinges necessitates additional filler pieces to complete the floor and side walls.

In view of the foregoing, a need exists for a collapsible portable unit which meets the standards for the container shipping industry so that it is easily transportable. A need also exists for a portable unit which is easily and quickly assembled without a need for heavy equipment or tools and which can withstand significant adverse weather conditions. Finally, a need exists for a unit which can be assembled on a variety of terrains and surface conditions without the need for constructing a foundation or pier beforehand.

SUMMARY OF THE INVENTION

The present invention alleviates to a great extent the deficiencies of the prior art by providing a portable unit which is foldable to be shipped and transported as a standard cargo shipping container.

In another aspect of the invention, the building walls, floors and roof panels are hinged to the building unit and are positioned to form the side wails of the container when in the closed position. The hinged panels are unfolded to form a building having approximately three times the floor space of the container in its closed position. The structure can be assembled by unfolding the panels without the need for special equipment or tools.

In another aspect of the invention, the front and rear wall panels are sloped at the top edges so that they are adjacent to the sloping roof of the completed structure to provide a weather seal.

In another aspect of the invention, the structure is supported on adjustable support jack stands. Therefore, a preconstructed foundation or pier is unnecessary. The unit can be constructed on a variety of terrains including hillsides, rocky terrain, and wet places without a permanent support structure.

In another aspect of the invention, the structure includes weather stripping along the top edge of the roof panels, soffits along the outer edges of the roof panels, overhangs on the wall and winged panels and trim panels plates at the comers and exterior seats. These features provide for a weather-tight construction without the need to seal or otherwise weatherize the structure.

In another aspect of the invention, the unit is refrigerated and utilizable as a portable mortuary. The portable mortuary unit may be expandable/collapsible or non-expandable.

Since the unit is constructed according to shipping standards, cargo may be transported within the unit, the unit does not need an understructure support during transportation, and multiple units can be stacked for transportation or storage.

Therefore, it is an object of this invention to provide a portable, collapsible unit which is easily transported and meets industry standards for container shipping. It is another object of the present invention to provide a portable unit which is easily assembled without the need for heavy tools or equipment. It is another object of the present invention to provide a unit which can be used on a variety of terrains and surfaces without a foundation. It is another object of the present invention to provide a refrigerated unit which is either expandable or not expandable.

With these and other objects, advantages and features of the invention that may become apparent, the nature of the invention may be more clearly understood by reference to the following detailed description of the invention, the appended claims and the several drawings attached hereto.

DETAILED DESCRIPTION OF A PREFERRED EMBODIMENT

Figure 1:
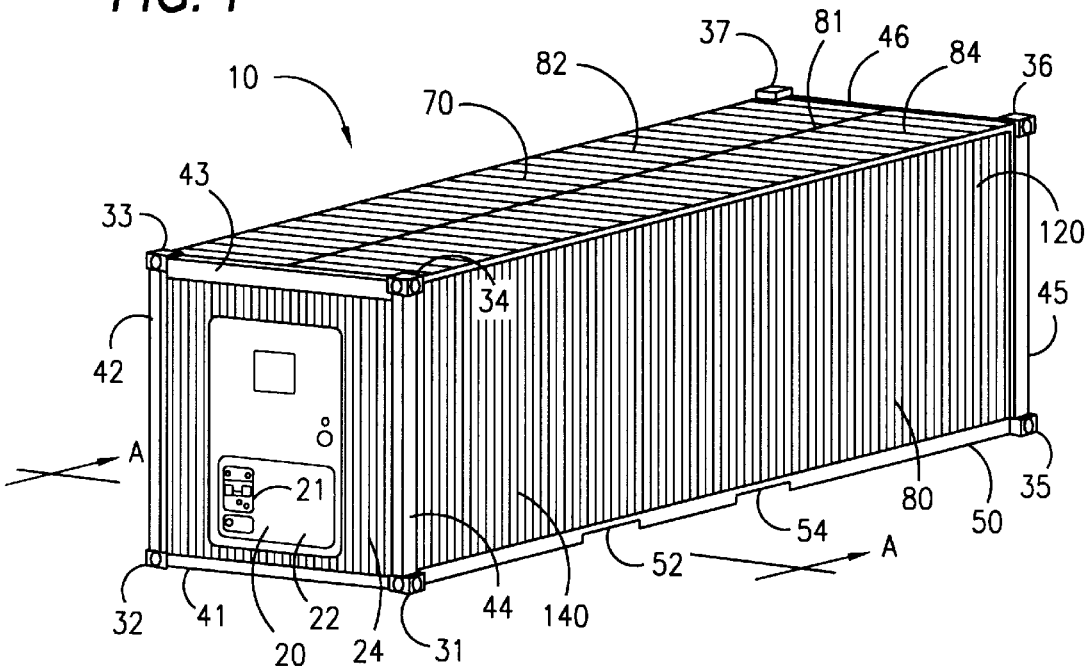
FIG. 1 is an oblique view of a portable unit according to a preferred embodiment of the present invention in the closed position.

Referring now in detail to the drawings, there is illustrated in FIG. 1 a portable unit, generally referred to by reference numeral 10, according to a preferred embodiment of the present invention in the closed position. When in the closed position, or container node, the unit 10 meets International Shipping Organization (ISO) requirements for the International Convention for Safe Containers (CSC) and for the American Bureau of Shipping (ABS). These standards include requirements for the size and strength of containers. The primary framing system is a welded assembly of fixed structural steel tube members 41–46 and 50, with standard cast steel comer fittings 31–37. The exterior of the unit 10 is preferably made of cold formed corrugated sheet steel panels. The unit 10 includes a door 22 in at least one end 20 which can be used to load materials when shipping the portable unit 10. The door 22 also includes a custom seal plate 21 as is found, for example, on ordinary cargo shipping containers. Since the unit is designed to meet the requirements for cargo containers, it can be lifted with a crane or forklift without the use of additional supports. The bottom support frame 50 includes forklift pockets 52, 54 for ease in transporting the unit 10. Also, multiple units can be stacked, up to four high, for shipping or storage.

Figure 2:
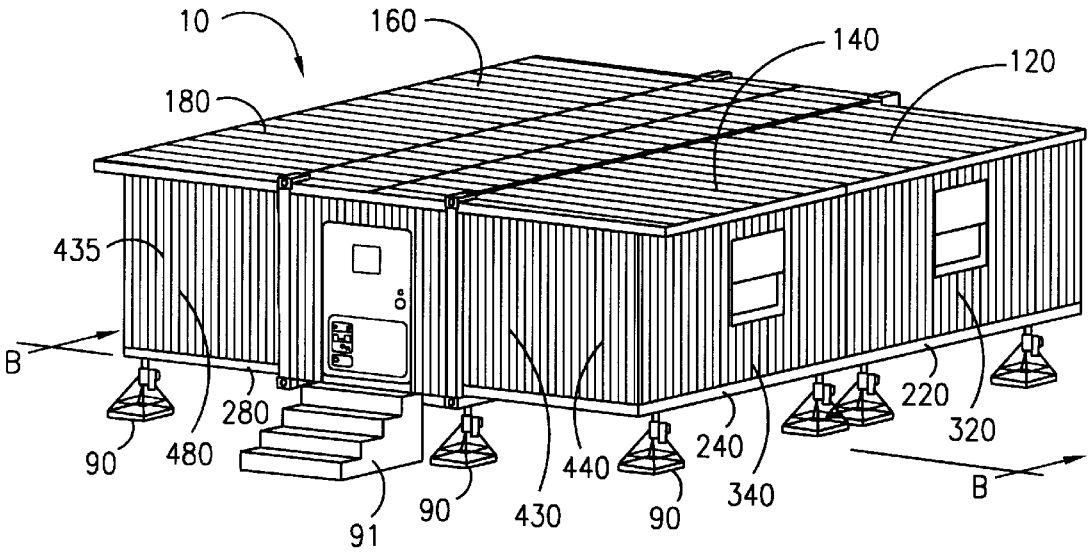
FIG. 2 is an oblique view of the portable unit of FIG. 1 in the open position.

When assembled, as illustrated in FIG. 2, the portable unit 10 has approximately three times the floor area of the closed container. The unit is supported on adjustable jack stands 90 which eliminate the need for a foundation. The adjustable jack stands also allow the portable unit 10 to be used on hilly, uneven or rocky terrain. A portable fiberglass stair section 91 can be used to enter the unit when assembled and supported off the ground.

Figure 3:
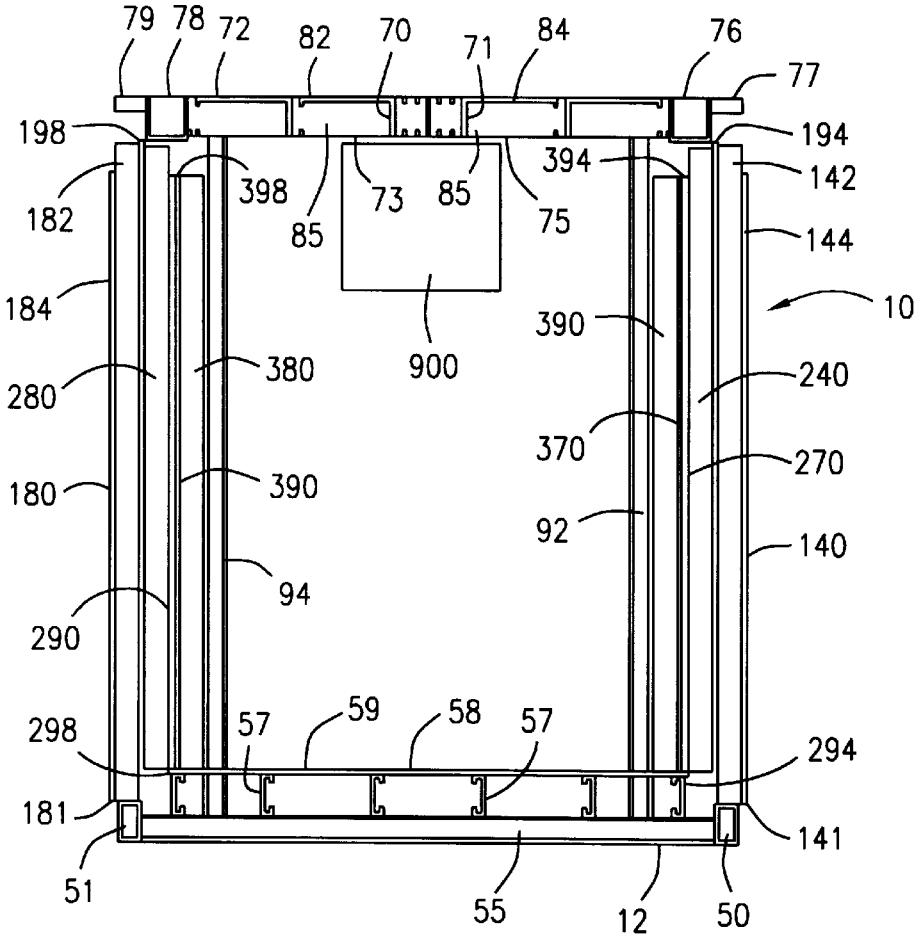
FIG. 3 is a cross sectional view of the unit of FIG. 1 along the line A—A.

FIG. 3 illustrates a cross sectional view of the portable unit 10 when in the closed position, across the line A—A of FIG. 1. The unit 10 shown in FIG. 3 includes a refrigeration system 900. With the refrigeration system 900, the unit may provide air conditioning and/or heating for living quarters or for controlled environment storage. For example, the refrigerated unit may be a portable mortuary storage unit for use in emergency situations under any weather conditions and aboard any ship, air transport or railway. The refrigerated unit may be expandable (as shown) or non-expandable.

When used as a non-expandable mortuary, the unit includes storage shelves, 24 or more for a unit with dimensions of about 20 feet in length by about eight feet in width by about eight feet in height. The refrigerated unit may also be provided in an expandable embodiment. The expandable refrigerated embodiment, which is ISO compliant in the closed position, will have closed dimensions of about 20 feet in length by about 9.5 feet in height by about eight feet in width. For example, the open dimensions of the expandable refrigerated embodiment will be about 20 feet in length by about 9.5 feet in height by about 25 feet in width and has approximately 500 square feet of storage space.

The bottom 12 of the unit 10 is formed by side frame members 50, 51 which run the entire length of the unit 10. Bottom support members 55 provide the undercarriage for the unit 10. The floor 58 is of structural plywood sheathing 59 that is supported by floor joints of steel C-beams 57 which rest on the bottom support members 55.

The roof 70 is formed of two panels 82, 84 which slope away from the center line 81. Each roof panel 82, 84 consists of an inner portion 73, 75 and an outer portion 72, 74 separated by C-beams 71. The outer portions 72, 74 are cold formed corrugated sheet steel. The space 85 between the inner portions 73, 75 and the outer portions 72, 74 of the roof panels 82, 84 can be filled with insulation (not shown).

The outer ends of the roof are formed by corner braces 76, 78 which run the length of the unit and provide structural support for the closed position shipping container. Roof flanges 77, 79 extend from the braces 76, 78 and provide a weather seal when the unit is in the open position. In addition to the corner braces 76, 78, the roof 70 is supported by the frame members on each end of the unit and by inside supports 92, 94 positioned along the interior of the container. The roof 70 of the unit in the closed position is also used as a section of the roof in the open position. The use of the same roof section increases the strength of the open unit and reduces the complexity of assembly and disassembly.

The side walls 80 are formed by the roof panels 140, 180. Like all panels in the unit, the roof panels 140, 180 are formed of a steel frame structure 142, 182 with corrugated sheet steel 144, 184 on the exterior surfaces 148, 188.

In the refrigerated unit embodiment, a heavy duty tubular steel frame is utilized for strength and reliability. The exterior panels are of cold-formed steel for excellent strength to weight ratio. Further, insulation is added to the panels. The insulation, which may be foamed-in, will provide a R-rating of preferably about 40 ° F.(hr)(ft)$^2$/BTU. With such insulation, the refrigerated units are designed to maintain sub-zero internal temperatures in extreme weather conditions.

The steel frame structure for each of the panels is further described with respect to FIGS. 9–14. An interior surface (not shown), such as plywood sheathing, can also be applied with insulation between the exterior and interior surfaces. The unit can be constructed in various lengths. Cargo container standards require twenty foot or forty foot lengths. For longer lengths, more panels would be used so that each panel is easy to maneuver. By way of example, a twenty foot unit with two adjacent panels is disclosed.

The roof panels 140, 180 are hinged to the corner braces 76, 78. The hinges 194, 198 are steel solid leaf butt hinges with welded ends. When in the closed position, the roof panels 140, 180 are latched at their free ends 141, 181 to the lower side frame members 50, 51. The floor panels 240,280 are attached to the floor 58 of the unit by hinges 294,298 and are disposed inside and adjacent to the roof panels 140, 180. The floor panels 240,280 are provided with a sub-flooring material 270,290 similar to that of the floor 58 of the unit 10. All of the floor members can also include floor coverings (not shown) such as carpet, finished plywood and vinyl flooring.

Figure 4:
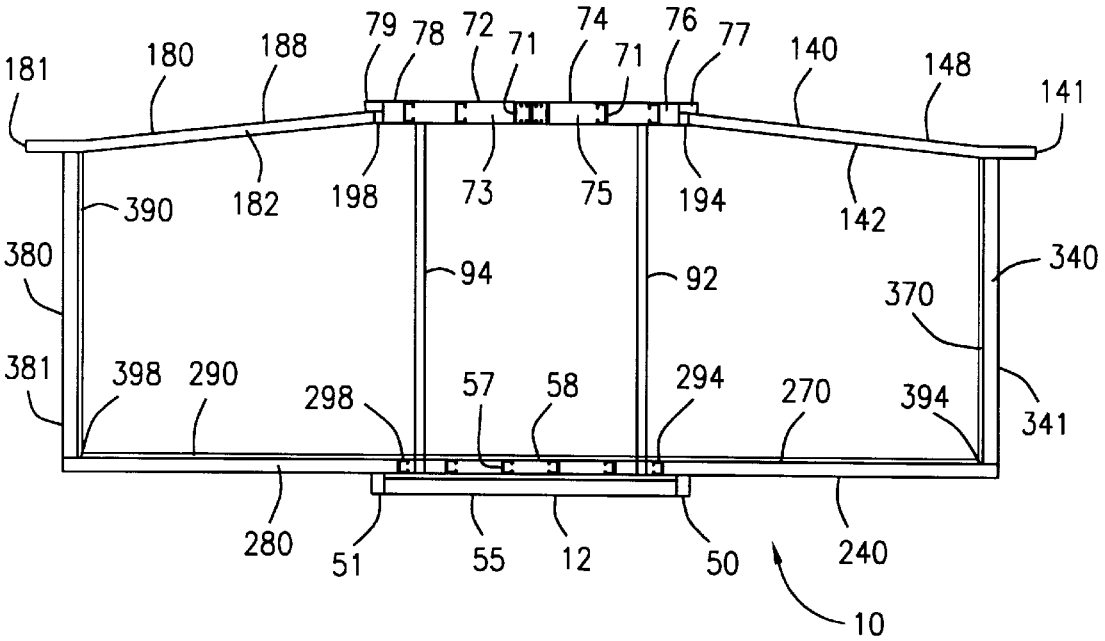
FIG. 4 is a cross sectional view of the unit of FIG. 2 along the line B—B.
Figure 5:
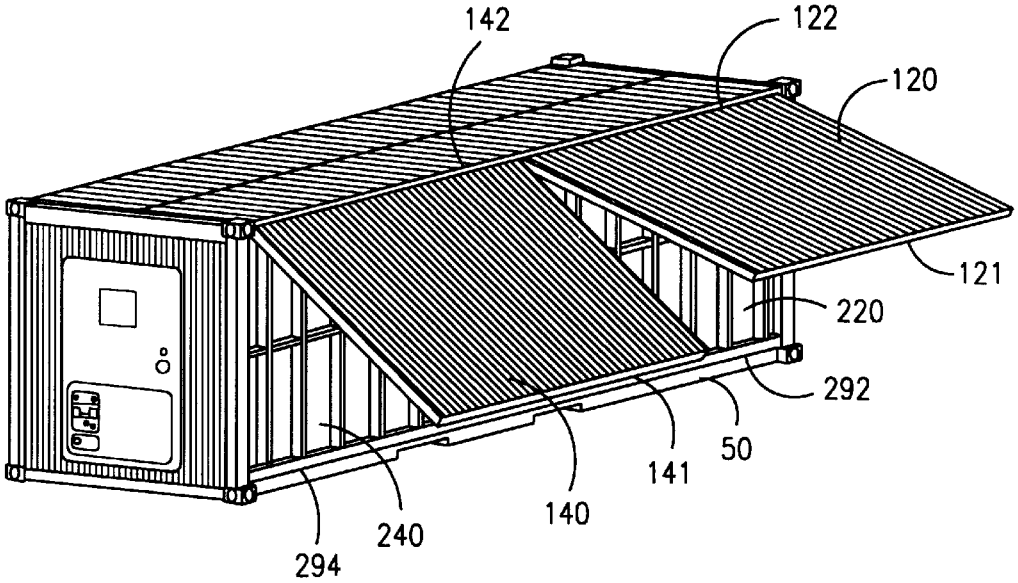
FIGS. 5–8 are oblique views of the portable unit of FIG. 1 at various stages in the assembly process.

When opened, the floor panels 240,280 are supported by the side frame members 50, 51 as well as by the adjustable jack stands 90. The end walls 340, 380 are hinged at the outer edges of the floor panels 240, 280. When in this open position, as illustrated in FIG. 4, the end wall panels 340, 380 are supported on the floor panels 240,280 and, in turn, support the outer ends 121, 141 of the roof panels 120, 140. The wall panels 340, 380 are also covered with an interior finish 370, 390 which can include plywood sheathing, gypsum sheathing, masonite, vinyl, or similar products. The exterior surfaces 341, 381 of the wall panels 340, 380 are of corrugated sheet steel. As with the roof 70 and the roof panels 140, 180, the floor panels 240,280 and the wall panels 340, 380 can include insulation between the exterior and interior surfaces.

The portable refrigerated storage unit embodiment includes a refrigeration system 900. The system 900, which includes a standard climate control unit, is designed to work in any weather condition, and to be fully operational on board any ship. The system 900 is attached to one of the ends 20. Included within the system 900 is one or more closable vent holes (not shown) positioned on the same end 20 as the rest of the system 900. The vent hole is utilized to allow air to be brought within the unit 10, heated and then ejected so as to maintain a lowered temperature within the unit 10.

In situations where external power cannot be employed, such as in the case of air transport, a supplemental cryogenic cooling system (not shown) or other device for supplemental power may further be employed with the portable refrigeration unit.

Figure 6:
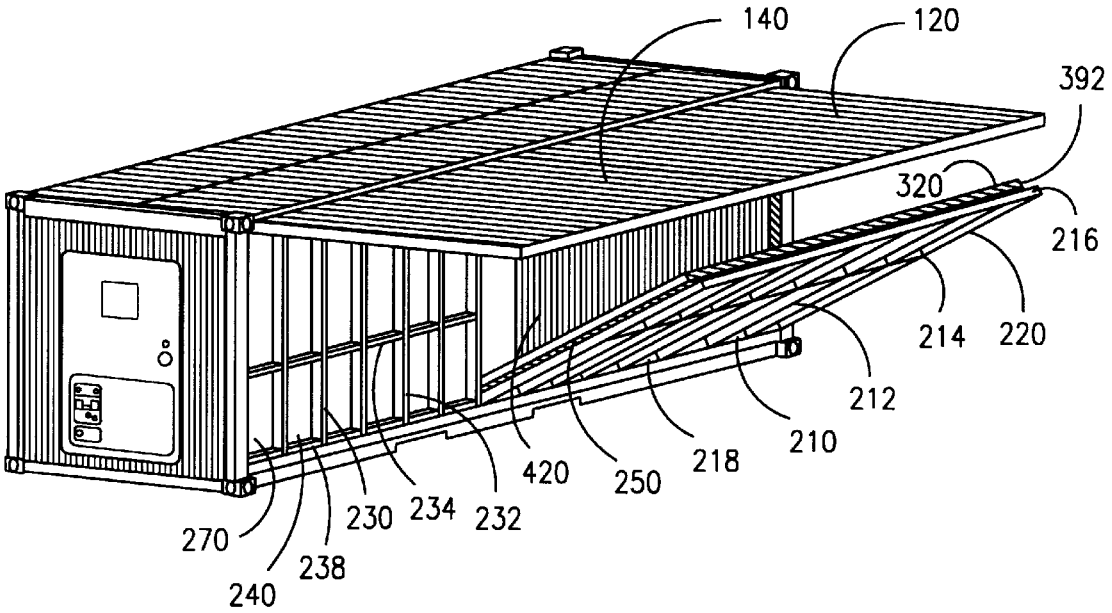
Figure 7:
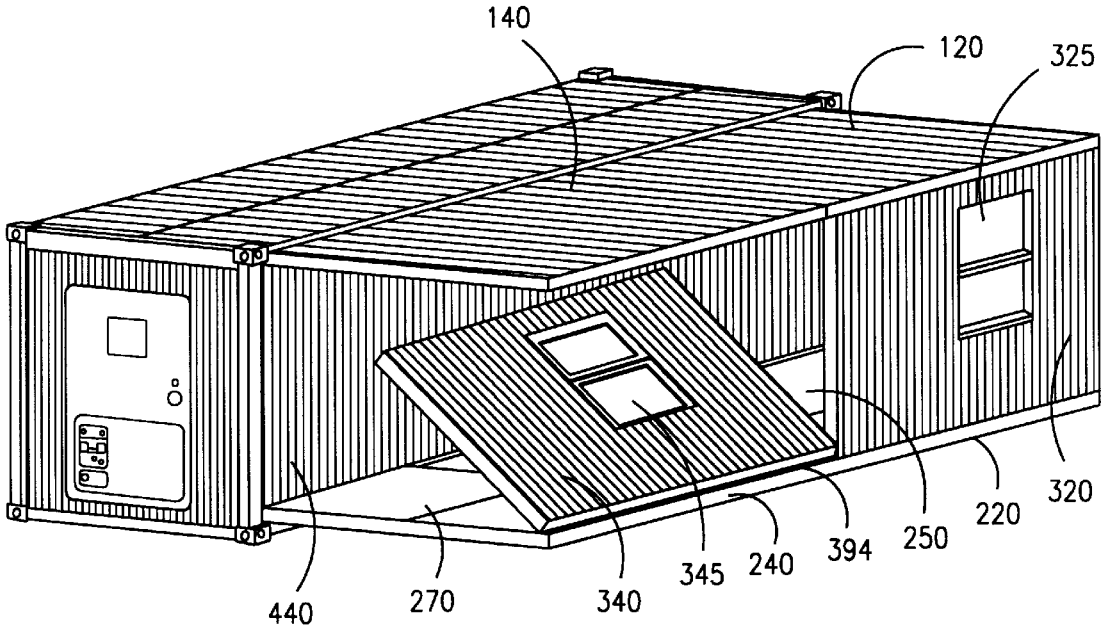

FIGS. 5–8 illustrate the process for assembling the portable unit. The free ends, 121, 141 of the roof panel are unlatched from the lower side frame member 50. The roof panels 120, 140 are attached by hinges along their upper ends 122, 142 to the unit 10. The roof panels 120, 140 are raised into position and temporarily supported by supports which are not shown. When the roof panels are opened, the bottom surface of the floor panels 220,240 are exposed. The bottom surface of the floor panels 220,240 include frame structures 210, 230. The frame structures consists of upright supports 212,232 and cross supports at the inner end 218, 238, the outer end 216,236 and the middle 214, 234. The sub-flooring 250, 270 is attached to the floor panel support structure. As illustrated in FIG. 6, the floor panels 220,240, which are hinged with hinges 292, 294 along the lower end to the unit floor are lowered into position. The wall panels 320, 340, which are hinged with hinges 392, 394 to the outer ends of the floor panels 220,240 are then raised into position and support the roof panels 120, 140. The wall panels 320, 340 can include windows 325, 345 or doors (not shown) in relation to the intended use of the unit. Additionally, the wall, roof and floor panels can be prewired for lights or electrical sockets.

Figure 8:
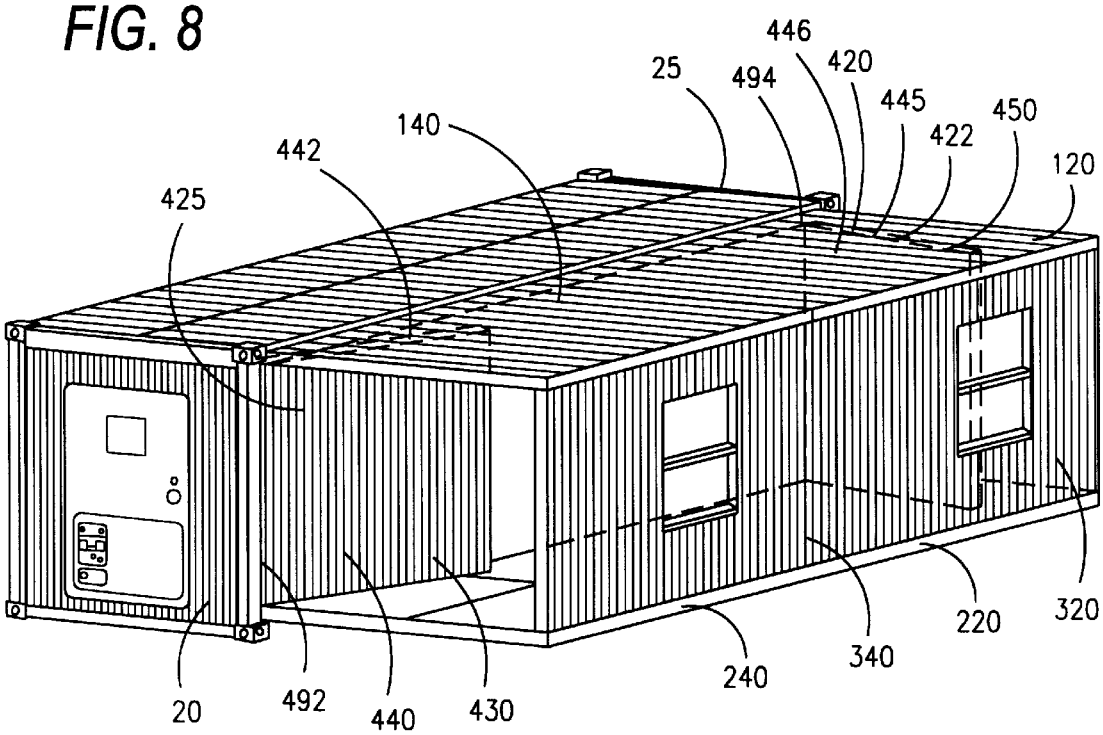

As shown in FIG. 8, winged panels 420,440, which are hinged with hinges 492, 494 along one side to the ends 20,25 of the unit 10, are rotated into position to form the front wall 430 and rear wall 450 of the unit. The upper surfaces 422, 442 of the winged panels 420,440 are sloped so that they abut and support the sloped roof panels 120, 140. As with the wall panels 320, 340, the winged panels 420,440 have corrugated sheet steel exterior surfaces 425,445 and A plywood sheathing, gypsum sheathing, masonite, vinyl or similar interior finishes 426,446.

All of the panels are then latched into position to provide a strong structure capable of withstanding hurricanes, earthquakes, snowstorms, and other significant weather conditions. Since the roof 70 of the unit 10 in the closed position provides the center roof portion of the open unit and the sloped winged panels 420, 440 abut the roof panels 120, 140, no additional panels or joints are necessary. Fewer joints result in a stronger and more weather-tight structure. Once the panels are latched into place, no additional weather sealing is necessary.

The same procedure is repeated with the panels on the other side of the unit 10 to complete the unit as illustrated in FIG. 2. The procedure can be easily reversed to disassemble the unit for transport to another location or to storage.

FIGS. 9–14 illustrate the frame structure for the various panels according to a preferred embodiment of the present invention. The frames are constructed of various shaped (C, U, L, and flat) steel beams, generally of 20 gauge steel. The beams are welded together to create a strong frame structure.

Figure 9:
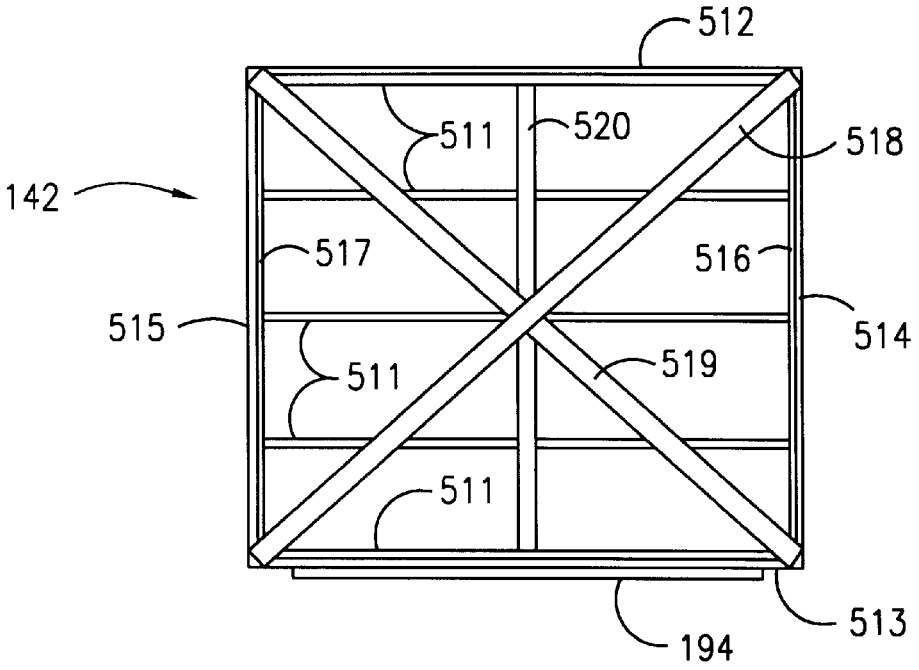
FIGS. 9–14 are plain views of the frame structures for the roof panels, floor panels, wall panels, winged panels and storage container ends, respectively.

FIG. 9 illustrates the frame structure 142 for a roof panel 140. C-shaped crossbeams 511 are welded at the ends to U-shaped end beams 516, 517. An outer structure of four C beams 512, 513, 514 and 515, are welded to the outside edges of the frame structure. An L-shaped crossbeam 520, which has cutouts to accept the crossbeams 511 is welded on top of the crossbeams 511. Finally, two flat diagonal beams 518, 519 are welded across the entire structure for added strength, since the roof panels form the sides of the container when in the closed position. The roof hinge 194 is welded to the outer structure along one of the C beams 513.

Figure 10:
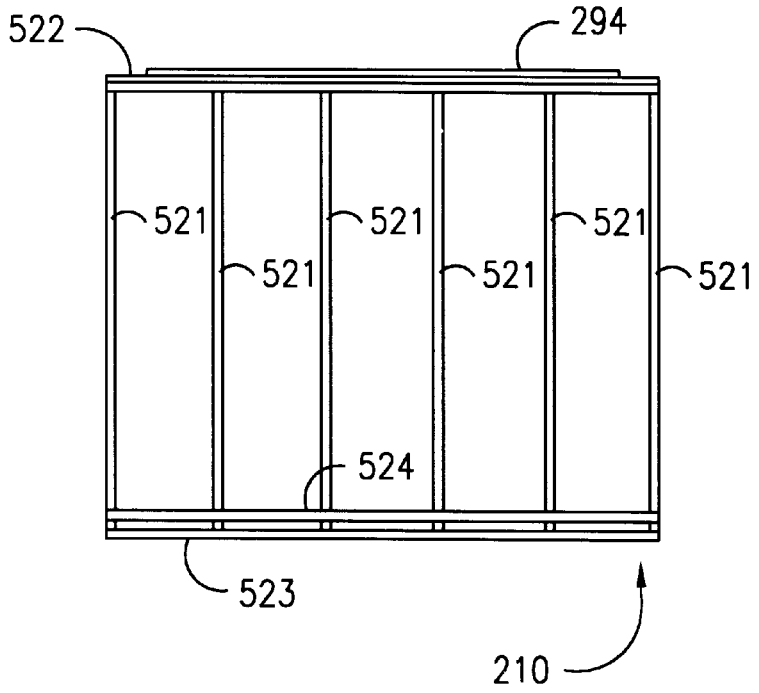

The frame structure 210 for the floor is illustrated in FIG. 10. C-shaped crossbeams 521 are welded at their ends to U-shaped end beams 523, 522. Two L-shaped beams 524, 525 (with cutout to accept the crossbeams) are welded across the crossbeams 521 to provide hinge supports. One L beam 525 (the floor panel hinge support) is welded at an end of the structure and has the hinge for the floor welded to it. The second L beam 524 is inset from the opposite end of the structure and has the hinge for the wall panel 394 welded to it. The second L beam 524 (the wall panel hinge support) is inset because the floor panel 240 supports the wall panel 340 at its outer edge and therefore the corresponding hinge is inset.

Figure 11:
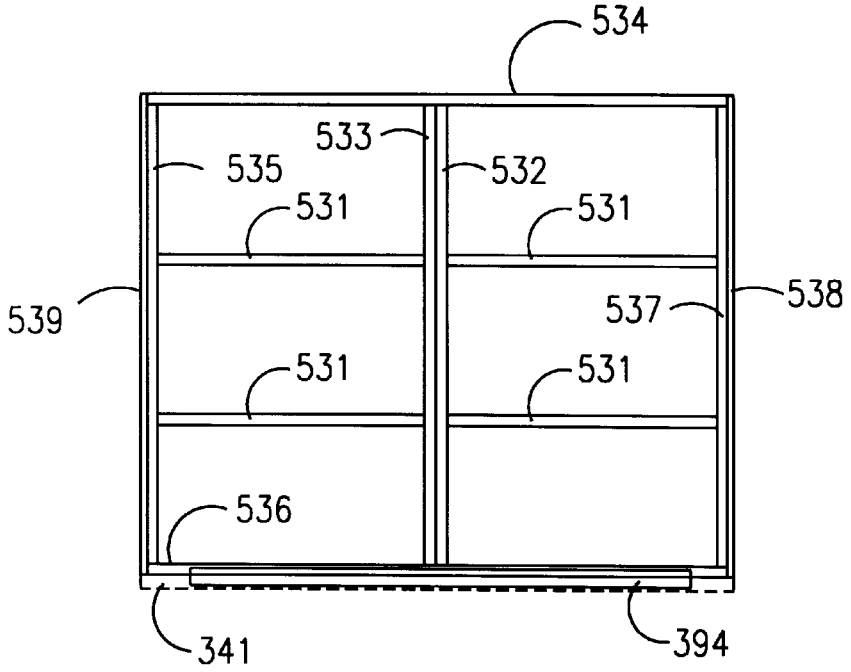

FIG. 11 illustrates the frame structure for a wall panel 340. Two C-shaped support beams 532, 533 are welded together to form the center of the frame. A C-shaped top beam 534 and bottom beam 536 are welded to the support beam and C-shaped end beams 537 and 535 are welded to the top 534 and bottom 536 beams at the ends. Four crossbeams 531 are welded between the central support beams and the end beams. U-shaped faceplates 538, 539 are welded to the outside of the end beams 535, 537. The end wall hinge 394 is welded to the bottom beam 536. In a preferred embodiment of the present invention, the exterior corrugated sheet steel 341 extends several inches below the bottom of the wall panel frame structure. When in the assembled position, this additional sheeting extends over and abuts an end beam 523 of the floor panel 240 to form a weather seal.

Figure 12:
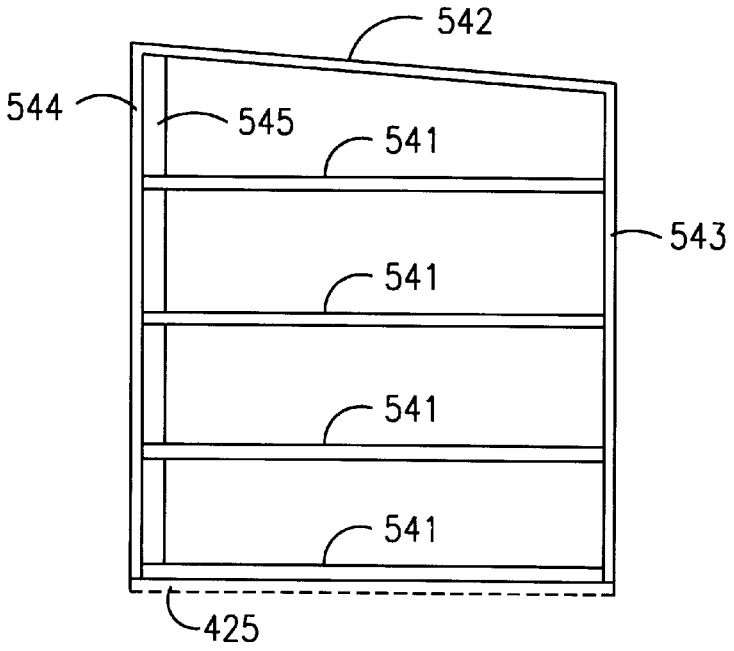

FIG. 12 illustrates the construction of the frame for a winged panel. As with the other panels, C-shaped crossbeams 541 are welded at their ends to U-shaped end beams 543, 544. A C-shaped top beam 542 is also welded to the end beams 543, 544 and is angled to support the sloping roof panels of the structure. An L-shaped beam 545 (with appropriate cutouts for the crossbeams) is welded across the crossbeams 541 and top beam 542 for attaching the hinge.

In a second preferred embodiment of the present invention, the winged panels are not hinged to the frame of the shipping container as disclosed above, but are separately attached. The steel corrugated sheeting on the exterior of the winged panels 425 extends several inches below the bottom of the frame structure. When constructed, the extra sheeting on the winged wall panel extends past the edge crossbeam 521 of the floor panel and provides a weather seal. In this second embodiment, a weather stripping material is applied to the L beam 545 which abuts the frame of the shipping container to provide a weather seal between the winged panels and the front and rear ends of the shipping container.

Figure 13:
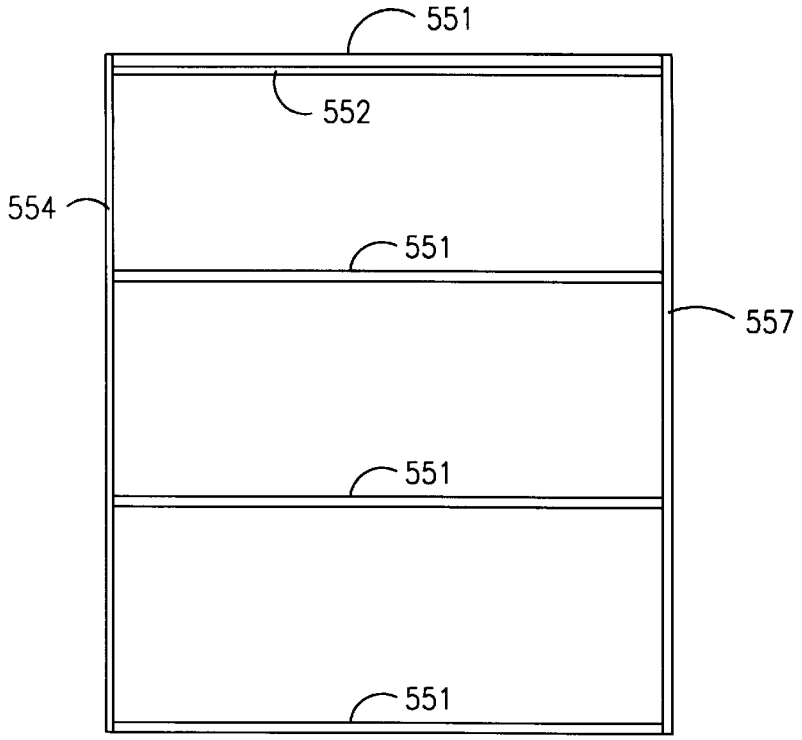

FIG. 13 illustrates the frame structure for an end of the shipping container. The frame structure consists of four C-shaped crossbeams 551 welded at their ends to two U-shaped end beams 553, 554. An L-shaped top beam 552 is welded along the topmost C beam 551 for additional strength.

Figure 14:
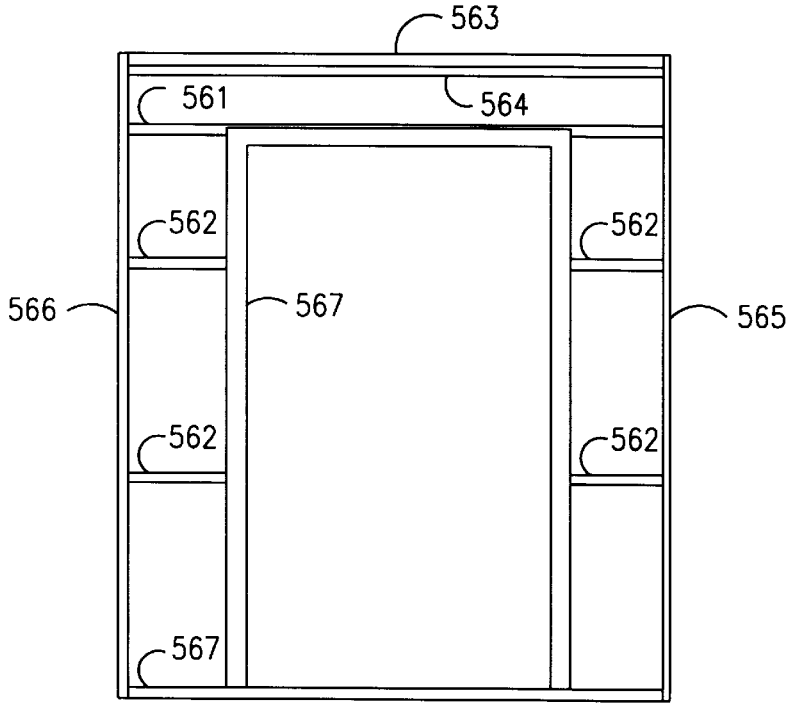

FIG. 14 illustrates the frame structure for the other end of the cargo shipping container which includes a door. The frame for a pre-hung steel door is welded to C-shaped crossbeams 561, 562 and a C-shaped bottom beam 567. U-shaped end beams 565, 566 are welded to the bottom beam 567 and the crossbeams 561, 562. A top crossbeam 563 and L-shaped beam 564 are welded to the top of the frame structure for added strength.

FIGS. 15–19 illustrates preferred embodiments of three jackstands 90 for use with the present invention. Each of the jackstands includes a base support 601, a support column 602, an adjustable screw support 603 and a mechanism for turning the screw 604 to raise or lower the jackstand.

Figure 18:
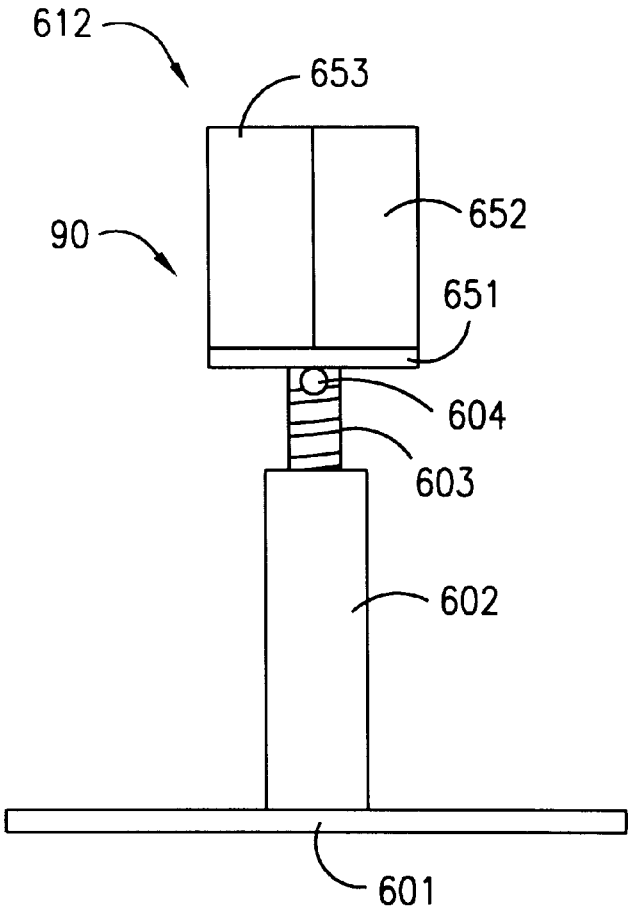
FIG. 18 is a side view of a third preferred embodiment of a jack stand of the present invention.
Figure 19:
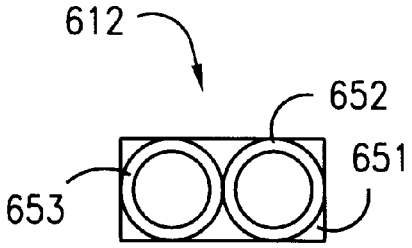
FIG. 19 is a top view of the jack stand of FIG. 18.

FIGS. 18 and 19 illustrate a jackstand for supporting the shipping container. A base plate 651 is attached to the adjustable screw of the jackstand. Two pipes 652, 653 are welded to the base plate 651 and to each other. The two pipes fit within the oval hole in the lower comer fittings 31, 32, 35 and support the main structure.

Figure 15:
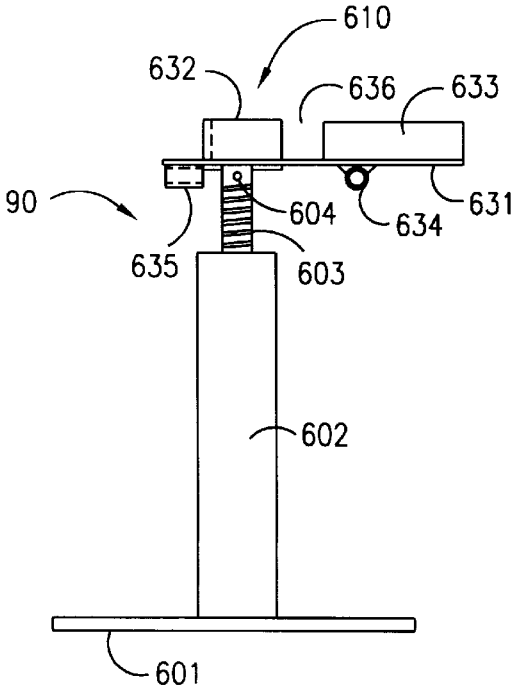
FIG. 15 is a side view of a jack stand according to one embodiment of the present invention.
Figure 16:
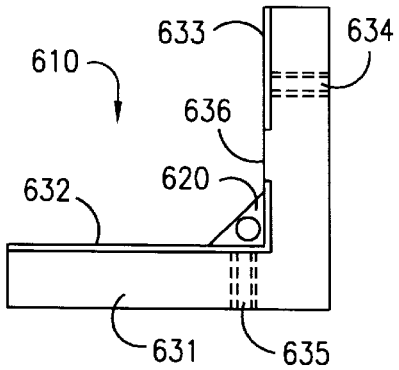
FIG. 16 is a top view of the jack stand of FIG. 15.

FIGS. 15 and 16 illustrate two views of a comer jack stand to support the outer corners of the floor panels. Vertical guide plates 632, 633 are attached to a base plate 631. The base plate 631 is attached to a comer plate 620 which is attached to the adjustable screw 603. The crossbeam 521 and end beam 523 of the floor panel frame structure (FIG. 10) are supported by the base plate and abut the vertical guide plates 632, 633. The wall panel hinge support 524 of the floor panel frame 210 is disposed in the space 636 between the vertical guide plates 632, 633.

Figure 17:
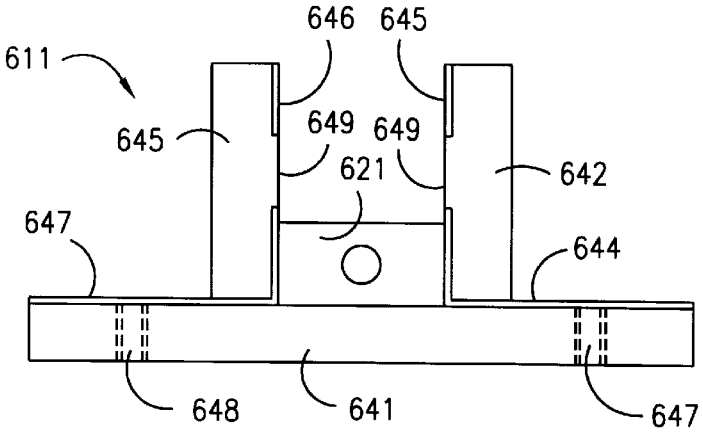
FIG. 17 is a top view of a second preferred embodiment of a jack stand of the present invention.

FIG. 17 illustrates a jackstand to support two adjacent floor panels. A front base plate 641 supports the U-shaped end beam 523 of both adjacent floor panel frames 210 (FIG. 10). A center base plate 621 attaches the front base plate to the adjustable screw 603 and also supports a crossbeam 521 of each floor panel frame 210. A set of vertical guide plates 644, 645, 646 and 647 abut the frame members of the two floor panels to hold the floor panels and jackstand in position. The spaces 649 between the guide plates admit the wall panel hinge support 524 of the floor panel frame 210 for each floor panel and the rear base plates 642, 643 help support the L-shaped hinge beam and the floor panel.

Figure 20:
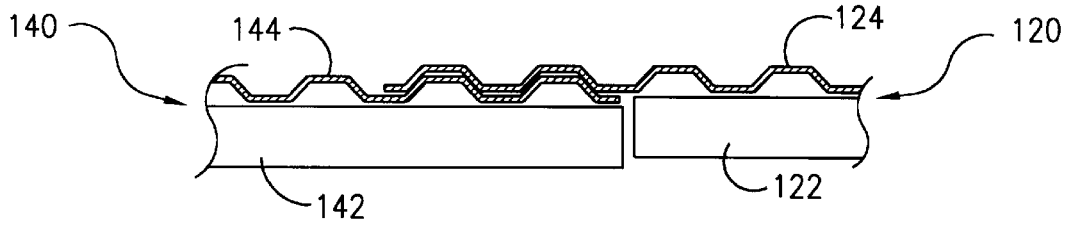
FIG. 20 is an end view of two adjacent roof panels according to a preferred embodiment of the present invention.

FIGS. 20–27 illustrate various aspects of a preferred embodiment of the present invention which create a weather-tight seal in construction. FIG. 20 illustrates the seal between two roof panels 120, 140. The corrugated steel sheeting for one of the panels 140 ends at the edge of the frame structure. The corrugated steel sheeting 124 for the other roof panel 120, extends past the edge of the frame structure 122 to overlap the steel sheeting 144 of the other roof panel 140. This provides a seal between the two roof panels.

Figure 21:
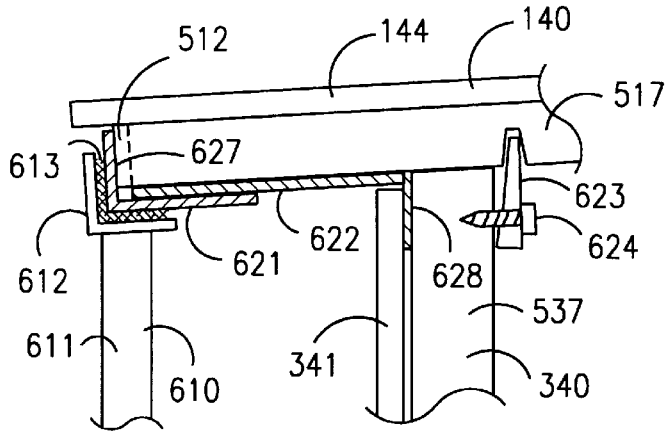
FIG. 21 is a side view of the roof and wall panel soffit according to a preferred embodiment of the present invention.

FIG. 21 illustrates a soffit between a roof panel 140 and a wall panel 340. An L-shaped soffit fascia 621 is welded 627 to the end beam 512 of the roof panel. An L-shaped soffit 622 is welded 628 to the frame structure of the wall panel 340 behind the exterior sheeting 341 of the wall panel. When the wall panel is raised into position the soffit 622 enters the space between the soffit fascia and the frame of the roof panel. To attach the wall panel, a pin 623 is inserted in a hole in the roof frame 142 and screwed to the wall panel 340. The soffit 622 and pin 623 prevent the wall panel from moving either for-ward or backward relative to the roof panel.

Also illustrated in FIG. 21 is a pike pole for raising and supporting the roof panel 140 before the walls are raised. The pike pole 610 consists of a pole 611 with an L-shaped steel member 612 attached to the top. A piece of carpet or other deformable material 613 can be attached to the inner surface of the L-shaped member to prevent scratching or marring the surface of the soffit fascia 621. The pipe pole is positioned on the outer corner of the roof panel as illustrated in FIG. 21 and moved into a vertical position so that the roof panel is supported in its raised position, once the end walls 340 are raised, the pipe poles can be removed and used to open the roof on the opposite side, or stored until needed for disassembly.

Figure 22:
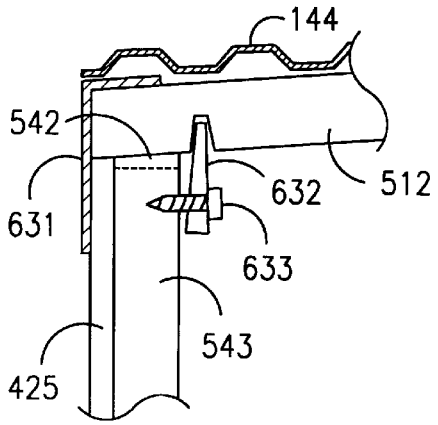
FIG. 22 is an end view of the roof and winged panel soffit according to a preferred embodiment of the present invention.

FIG. 22 illustrates the weather seal between a roof panel 140 and a winged panel. An L-shaped fascia 631 is welded to the frame of the roof panel under the exterior sheeting 144 along the entire side of the roof panel. This fascia extends several inches below the frame of the roof panel. When in the assembled position, the exterior sheeting 425 of the winged panel abuts the fascia 631, maintains the position between the roof and the winged panel and provides a weather seal. As with the wall panels, the winged panel can be maintained in position by a pin 632 inserted in a hole in the frame of the roof panel which is then screwed to the winged panel. Or, the frame of the winged panel can be screwed to the frame of the wall panel where the two panels abut one another.

Figure 23:
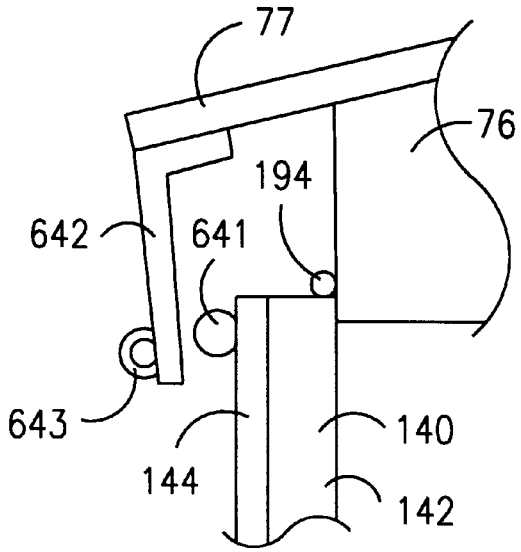
FIGS. 23 and 24 are end views of the roof panel weather seal according to a preferred embodiment of the present invention.
Figure 24:
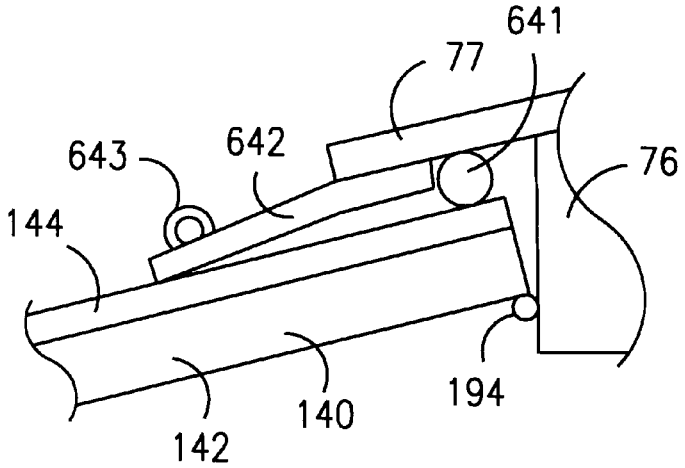

FIGS. 23 and 24 illustrate the weather seal between the roof panel and the frame structure of the shipping container. The roof panel 140 is hinged to the comer brace 76 along its entire length. Weather stripping 641 is provided along the upper edge of the roof panel on the exterior sheeting 144. When raised into position, the weather stripping provides a seal between the exterior surface of the roof panel 144 and the roof flange 77 which extends from the corner brace 76. A rubberized flange extension 642 is attached to the lower surface of the roof flange 77. When the roof panel is raised, as illustrated in FIG. 24, the flange extension lays across the upper surface of the roof panel to prevent rain from entering between the flange and the roof panel. When the roof panel is in the closed position, as illustrated in FIG. 23, the flange extension hangs down to cover the space between the roof flange 77, the comer brace 76 and the roof panel 140. The flange extension 642 preferably has several rings 643 attached to the outer edge so that the flange extension 642 may be strapped down when transporting the container.

Figure 25:
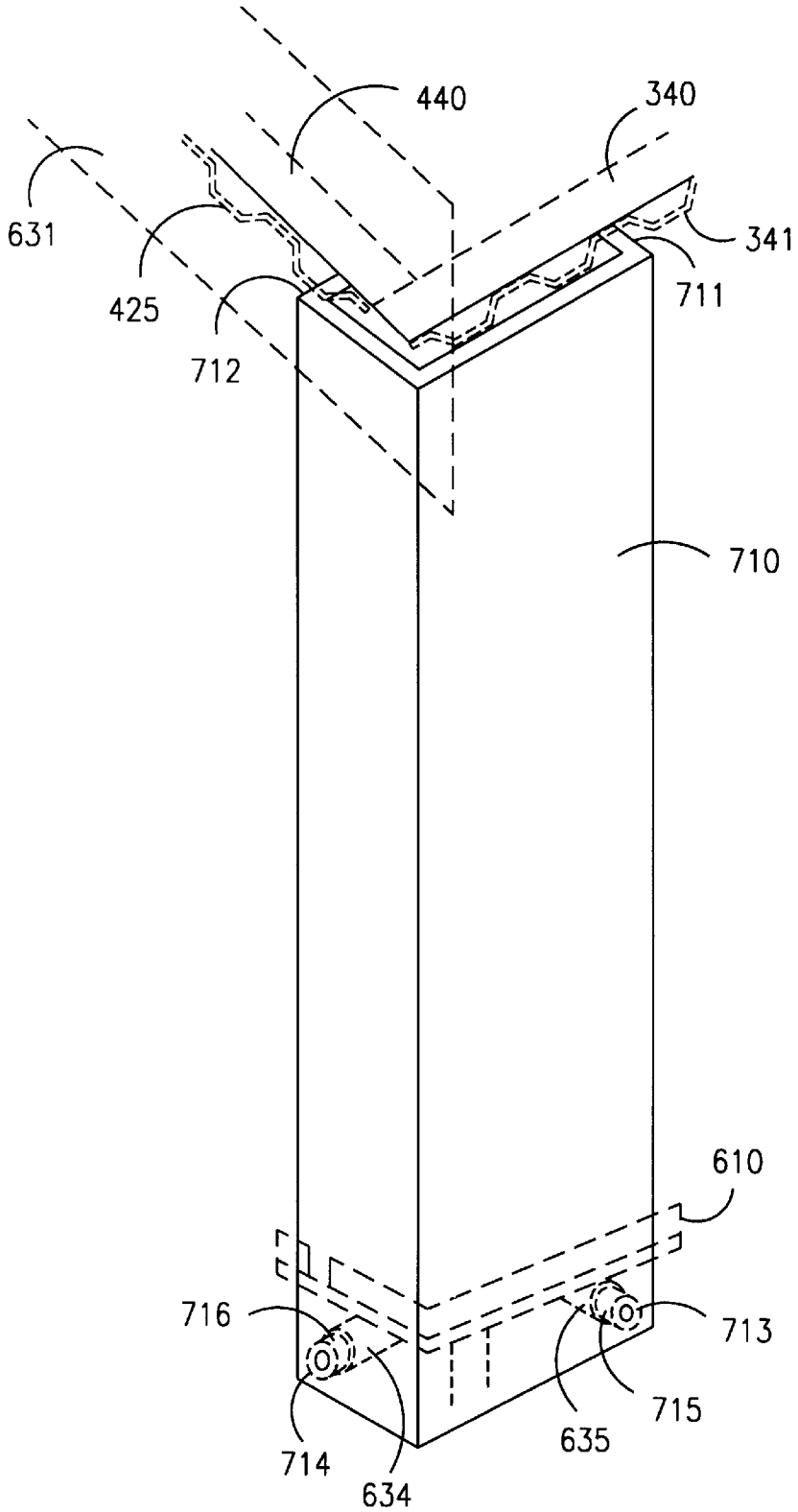
FIG. 25 is an oblique view of a corner trim panel according to a preferred embodiment of the present invention.
Figure 26:
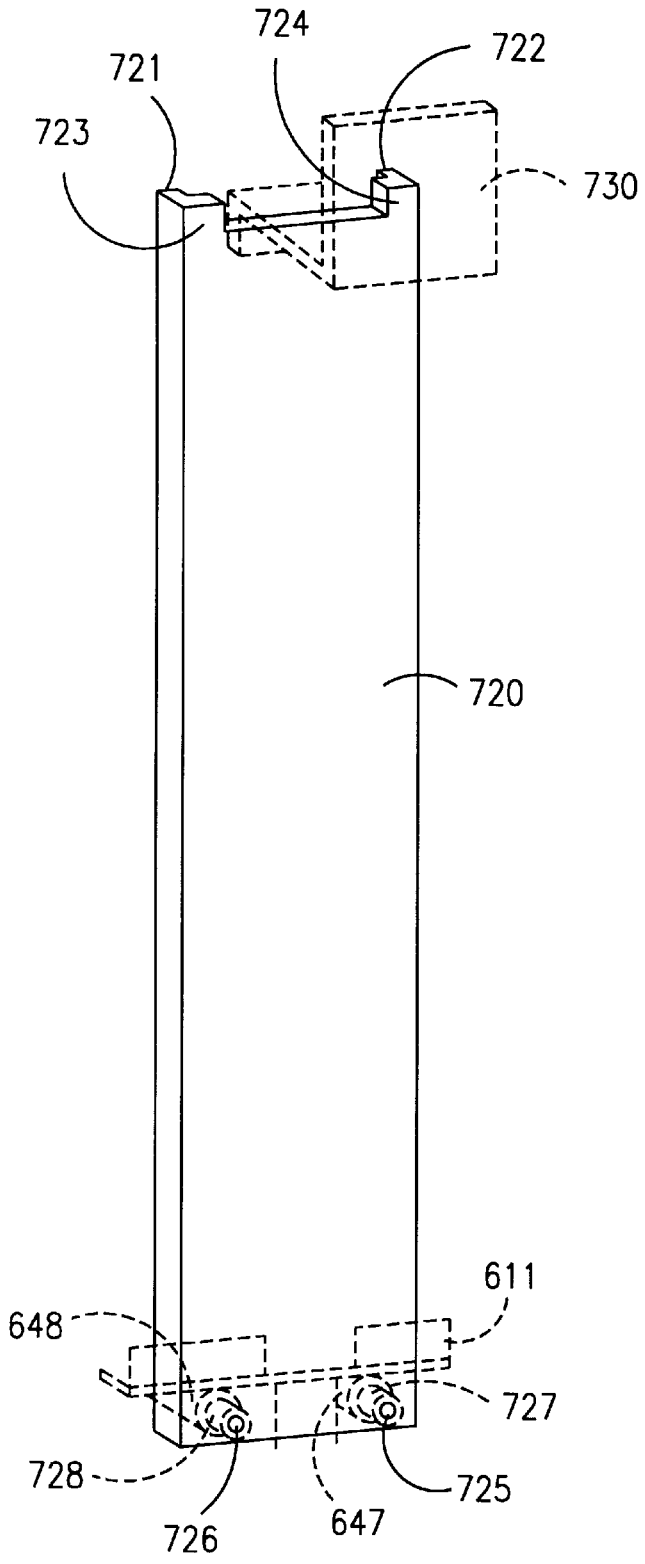
FIG. 26 is an oblique view of a mid-wall trim panel according to a preferred embodiment of the present invention.
Figure 27:
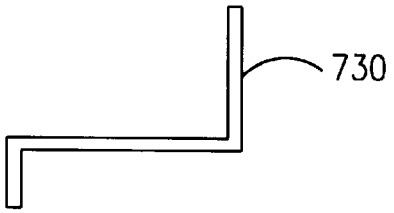
FIG. 27 is a side view of a mid-wall soffit according to a preferred embodiment of the present invention.

FIGS. 25–27 illustrate the trim for supporting and weatherizing vertical spaces between panels. FIG. 25 illustrates a corner trim panel 710 which has two perpendicular long sides and two short sides 711, 712 perpendicular to the ends of the long sides. The short sides 711, 712 are disposed within a trough of the corrugated steel exterior surfaces 341,425 of a wall panel 340 and a winged panel 440. The corner trim is also held in place by the edge fascia 631 of the roof panel. Along the bottom edge are two holes 713, 714, each with a short piece of pipe 715, 716 welded behind it. The holes and pipes are aligned with similar pipes 635, 634 welded to the base plate of the corner jackstand 610. Bolts are inserted through the holes 713, 714 and the pipes on both the corner trim panel and the jackstand and secured with a nut.

FIG. 26 illustrates a mid-wall trim panel 720 for covering and weatherizing the space between adjacent wall panels 320, 340. The mid-wall trim panel 720 is U-shaped having two short sides 721 and 722 which are disposed within the troughs of the exterior sheeting of the end wall panels. Two small extensions 723,724 of the mid-wall trim panel 720 are inserted in holes cut in the frame of the roof panels to prevent the mid-wall trim panel from moving out of place. Along the lower edge of the mid-wall trim panel 720, are two holes 725, 726 with small pieces of pipe 727, 728 welded behind. As with the corner trim panel, these holes and pipes align with pipes 647, 648 welded to the front base plate 641 of the mid-wall jackstand 611 and are secured with nuts and bolts. A mid-wall soffit trim 730, as illustrated in FIG. 27, is inserted behind the mid-wall trim panel and covers the space between the frame structures of the adjacent roof panels.

Figure 28:
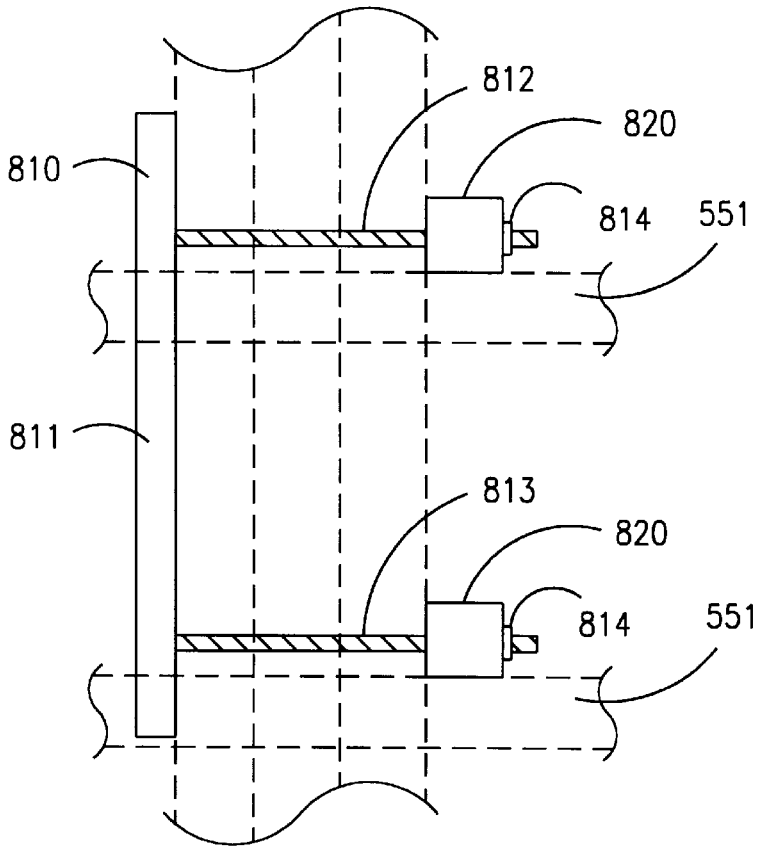
FIG. 28 is a plan view of a connector for the portable unit according to a preferred embodiment of the present invention.
Figure 29:
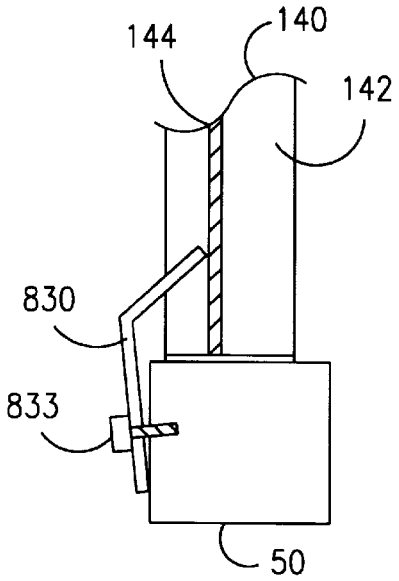
FIGS. 29 and 30 are side and plan views of a second connector according to a preferred embodiment of the present invention.
Figure 30:
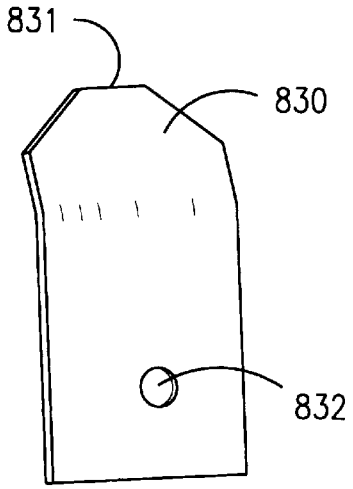

FIGS. 28–30 illustrate connectors for securing the panels in position when transporting the shipping container. FIG. 28 illustrates an edge connector 810 consisting of a pipe 811 and two large bolts 812, 813 welded perpendicular to the pipe. The bolts 812, 813 are of a size such that they can fit in the space between the panels and the frame at the end of the shipping container. The pipe 811 is larger than this space and thus is maintained against the outside of the roof panels 140 next to the end frame structure 44. Supports 820 are attached to the bolts 812, 813 with a nut 814. By tightening the nut, the roof panel 140, floor panel 240, and wall panel 340 are held together and cannot move relative to each other. This prevents any of the panels from moving while the container is being shipped. The supports 820 can be designed to rest on the C-shaped crossbars 551 of the shipping container end frame.

FIGS. 29 and 30 illustrate a connector for attaching the roof panel to the bottom support frame 50 away from an end of the shipping container. An angled connector 830, having a hole 832 toward one end, is shaped at the other end so as to fit within a trough of the corrugated steel exterior sheeting 144 of the roof panel 140. The connector 830 is then attached with a screw 833 at the bottom edge of the roof panel 140 to the bottom support frame 50 to prevent the roof panel from moving.

Although a preferred embodiment is specifically illustrated and described herein, it will be appreciated that modifications and variations of the present invention are covered by the above teachings and within the purview of the appended claims without departing from the spirit and intended scope of the invention.

What is claimed as new and desired to be protected by Letters Patent of the United States is:

1. A portable shelter, comprising:

a fixed structure being a container of a size, shape and strength for cargo shipping;

at least one roof panel hinged to said fixed structure along a roof panel top edge such that said at least one roof panel forms a portion of a side of said fixed structure when in a closed position, said at least one roof panel having a soffit fascia attached along a roof panel bottom edge opposite said roof panel top edge;

at least one floor panel hinged to said fixed structure along a floor panel bottom edge such that said at least one floor panel is disposed adjacent to said at least one roof panel when in said closed position;

at least one wall panel hinged to said at least one floor panel along a hinged edge of said wall panel opposite from said fixed structure such that said at least one wall panel is disposed adjacent to said at least one floor panel when in said closed position, said at least one wall panel having a soffit attached along a wall panel edge opposite from said hinged edge, such that said soffit engages said soffit fascia when in an assembled position;

at least two winged panels each having a sloped top edge, wherein said sloped top edge is adjacent said at least one roof panel in said assembled position; and a refrigeration unit coupled to the fixed structure to provide a controlled environment within the fixed structure when said fixed structure is in both its closed position and assembled position.

2. The portable shelter according to claim 1, wherein said soffit and soffit fascia provide a weather seal between said at least one wall panel and said at least one roof panel.

3. The portable shelter according to claim 1, further comprising:

at least two corner train panels, each corner trim panel being disposed about an edge between said at least one wall panel and one of said at least two winged panels to provide a weather seal.

4. The portable shelter according to claim 3, further comprising:

at least two supports, each of said supports being disposed under each of said edges for supporting said edge and said corner trim panels.

5. The portable shelter according to claim 1, wherein said portable shelter includes at least two adjacent wall panels, further comprising:

at least one mid-wall trim panel being disposed at a juncture between said at least two adjacent wall panels to provide a weather seal between said at least two adjacent wall panels.

6. The portable shelter according to claim 4, further comprising:

a support under said adjacent wall panels for supporting said wall panels and said mid-wall trim panel.

7. The portable shelter according to claim 6, wherein said portable shelter includes at least two adjacent roof panels, further comprising:

at least one soffit trim panel engaging said mid-wall trim panel to provide a weather seal between said at least two adjacent roof panels.

8. The portable shelter according to claim 1, wherein each of said at least one wall panels further includes:

a frame structure; and an exterior sheeting, wherein said exterior sheeting extends beyond said frame structure along said hinged edge and wherein said exterior sheeting overlaps an edge of said at least one floor panel when in said assembled position to form a weather seal.

9. The portable shelter according to claim 1, wherein each of said at least one winged panels further includes:

a frame structure; and an exterior sheeting, wherein said exterior sheeting extends beyond said frame structure along a bottom edge and wherein said exterior sheeting overlaps an edge of said at least one floor panel when in said assembled position to form a weather seal.

10. The portable shelter according to claim 1, further comprising:

a strip of flexible material along said top edge of said at least one roof panel, wherein said strip of flexible material forms a weather seal between said at least one roof panel and said fixed structure.

11. The portable shelter according to claim 1, wherein a space exists between said fixed structure and said top edge of said at least one roof panel, said portable shelter further comprising:

a flexible material attached to said fixed structure so as to releasably cover said space between said fixed structure and said top edge.

12. The portable shelter according to claim 11, further comprising means for securing said flexible material when the shelter is transported.

13. The portable shelter according to claim 1, further comprising securing means for preventing movement of said at least one roof panel, said at least one floor panel and said at least one wall panel when in said closed position.

14. The portable shelter according to claim 13, wherein said securing means joins together said at least one roof panel, said at least one floor panel and said at least one wall panel when in said closed position.

15. The portable shelter according to claim 1, wherein said refrigeration unit provides air conditioning within the portable shelter to permit use of the portable shelter as a mortuary.

16. A mobile expandable structure comprising:

a container of a size, shape and strength for cargo shipping when the mobile expandable structure is in a non-expanded state;

at least one roof panel coupled to said container for formation of a roof portion of the mobile expandable structure in its expanded state;

at least one floor panel coupled to said container for formation of a floor portion of the mobile expandable structure in its expanded state;

at least one wall panel coupled to said at least one floor panel for formation of a wall portion of the mobile expandable structure in its expanded state; and an air-control unit enclosed within said container to provide a controlled environment within said container.

17. The mobile expandable structure as recited in claim 16, wherein said air-control unit provides heated air circulated within said container.

* * * * *